United States Patent [19]

Hirai et al.

[11] 4,456,475

[45] Jun. 26, 1984

[54] PROCESS FOR PREPARING FERROMAGNETIC PARTICLES COMPRISING METALLIC IRON

[75] Inventors: Shigeo Hirai, Otsu; Toshinobu Sueyoshi, Kyoto; Masahiro Amemiya, Osaka, all of Japan

[73] Assignee: Hitachi Maxell, Ltd., Osaka, Japan

[21] Appl. No.: 516,432

[22] Filed: Jul. 25, 1983

Related U.S. Application Data

[63] Continuation of Ser. No. 268,498, May 29, 1981, abandoned.

[30] Foreign Application Priority Data

| | | | |
|---|---|---|---|
| May 30, 1980 | [JP] | Japan | 55-73012 |
| May 30, 1980 | [JP] | Japan | 55-73014 |
| Jun. 10, 1980 | [JP] | Japan | 55-78749 |

[51] Int. Cl.[3] ..... H01F 1/06

[52] U.S. Cl. ..... 75/0.5 AA; 75/0.5 BA; 148/105

[58] Field of Search ..... 75/0.5 A, 0.5 AA, 0.5 BA; 148/105; 252/62.56

[56] References Cited

U.S. PATENT DOCUMENTS

| | | | |
|---|---|---|---|
| 4,056,410 | 11/1977 | Corradi et al. | 75/0.5 BA |
| 4,115,106 | 9/1978 | Snavely et al. | 75/0.5 AA |
| 4,133,677 | 1/1979 | Matsuij et al. | 75/0.5 AA |
| 4,290,799 | 9/1981 | Schroeder et al. | 75/251 |

*Primary Examiner*—Michael L. Lewis

*Attorney, Agent, or Firm*—Birch, Stewart, Kolasch & Birch

[57] ABSTRACT

A process for preparing ferromagnetic particles comprising metallic iron as the major component by oxidizing $Fe(OH)_2$ in an aqueous medium adjusted to a pH of not less than 11 with gaseous oxygen to produce particles of $\alpha$-FeOOH, optionally followed by dehydration of the $\alpha$-FeOOH particles under heating to produce particles of $\alpha$-$Fe_2O_3$, and reducing the $\alpha$-FeOOH or $\alpha$-$Fe_2O_3$ particles under heating, characterized in that (1) the aqueous medium at the oxidation step comprises at least one metal compound chosen from compounds of alkaline earth metals, zinc and aluminum and (2) the coating of a silicon compound is applied to the $\alpha$-FeOOH or $\alpha$-$Fe_2O_3$ particles before the reduction step, whereby the ferromagnetic particles of metallic iron having enhanced magnetic characteristics are obtained.

6 Claims, 1 Drawing Figure

PROCESS FOR PREPARING FERROMAGNETIC PARTICLES COMPRISING METALLIC IRON

This application is a continuation, of application Ser. No. 268,498 filed on May 29, 1981 now abandoned.

The present invention relates to a process for preparing ferromagnetic particles comprising metallic iron. More particularly, it relates to a process for preparing ferromagnetic particles of metallic iron having excellent magnetic characteristics which controls the size and axis ratio of the particles and prevents the particles from sintering and breaking.

In general, ferromagnetic particles comprising metallic iron as the major component have better magnetic characteristics than ferromagnetic particles of iron oxide such as $Fe_3O_4$ or $\gamma$-$Fe_2O_3$ and are used as recording elements for magnetic recording media such as magnetic recording tapes. Since the ferromagnetic particles of metallic iron are usually prepared by reduction of needle-shaped particles of $\alpha$-FeOOH or $\alpha$-$Fe_2O_3$ as the starting material under heating, their properties such as size and shape are greatly dependent upon the properties of the said starting material, and their magnetic characteristics as well as their suitability for magnetic recording media are much influenced by such properties. On the other hand, the heat treatment of $\alpha$-FeOOH or $\alpha$-$Fe_2O_3$ particles for reduction and, in case of using $\alpha$-$Fe_2O_3$ particles, further for dehydration of $\alpha$-FeOOH particles to $\alpha$-$Fe_2O_3$ particles tends to cause sintering between the particles, partial melting of each particle, formation of micropores, etc., whereby the evenness of the particle size, the needle-shape of the particles and the density of the particles become inferior so that the magnetic characteristics of the ferromagnetic particles are markedly deteriorated. Therefore, in order to obtain ferromagnetic particles of metallic iron having excellent magnetic characteristics, it is necessary to use $\alpha$-FeOOH or $\alpha$-$Fe_2O_3$ having good properties and imparting such good properties to the ferromagnetic particles.

It was previously found that in the production of particles of $\alpha$-FeOOH by oxidation of $Fe(OH)_2$ suspended in an aqueous medium with gaseous oxygen, the maintenance of the aqueous medium at an alkaline pH can provide very dense particles of $\alpha$-FeOOH, and reduction of such $\alpha$-FeOOH particles or $\alpha$-$Fe_2O_3$ particles derived therefrom under heating also glues very dense ferromagnetic particles of metallic iron, which have a high mechanical strength.

Subsequent study has now revealed that the incorporation of at least one metal compound chosen from compounds of alkaline earth metals, zinc and aluminum into the aqueous medium in the said production of $\alpha$-FeOOH particles while maintaining the aqueous medium at an alkaline pH and the application of a coating film of a silicon compound onto the surfaces of the particles of $\alpha$-FeOOH or $\alpha$-$Fe_2O_3$ before reduction under heating are effective in controlling the size and axis ratio of the produced particles and preventing sintering and breaking of the produced particles on the heat treatment to give ferromagnetic particles of metallic iron of good density with excellent magnetic characteristics.

According to the present invention, there is provided a process for preparing ferromagnetic particles comprising metallic iron as the major component by oxidizing $Fe(OH)_2$ in an aqueous medium adjusted to a pH of not less than 11 with gaseous oxygen to produce particles of $\alpha$-FeOOH, optionally followed by dehydration of the $\alpha$-FeOOH particles under heating to produce particles of $\alpha$-$Fe_2O_3$, and reducing the $\alpha$-FeOOH or $\alpha$-$Fe_2O_3$ particles under heating, characterized in that (1) the aqueous medium at the oxidation step comprises at least one metal compound chosen from compounds of alkaline earth metals, zinc and aluminum and (2) the coating of a silicon compound is applied to the $\alpha$-FeOOH or $\alpha$-$Fe_2O_3$ particles before the reduction step, whereby ferromagnetic particles of metallic iron having enhanced magnetic characteristics are obtained.

In one of the characteristic features of the invention, the aqueous medium at the oxidation step comprises at least one metal compound chosen from compounds of alkaline earth metals, zinc and aluminum. The metal component in such metal compound is co-precipitated with particles of $\alpha$-FeOOH produced by oxidiation of $Fe(OH)_2$ and retained in the ferromagnetic particles of metallic iron as the ultimate product obtained from the $\alpha$-FeOOH particles. The metal component affords a great influence on the size and axis ratio of the particles, and favorable values for these characteristics as well as desired magnetic characteristics can be realized by appropriately controlling the amount of the metal component to be taken into the particles.

Figure 1:
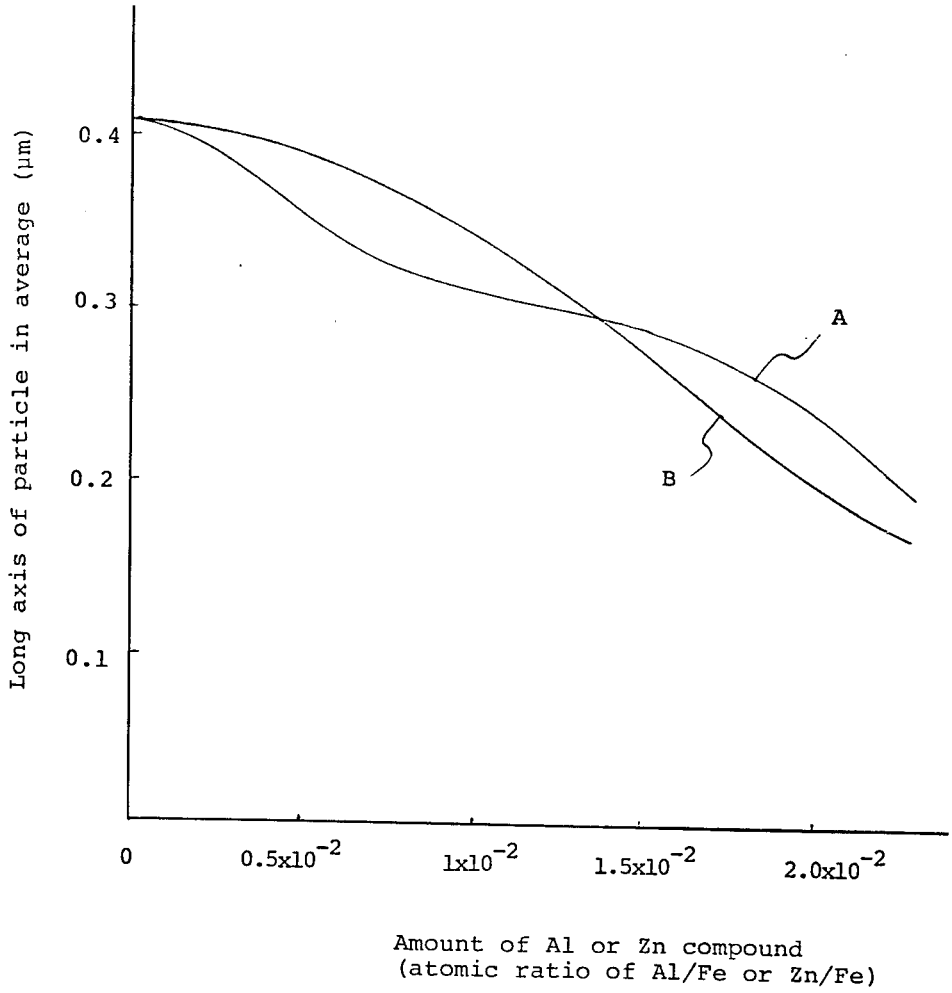
FIG. 1 is a graph of size versus atomic ratios of coating amount to Fe.

Curves A and B of the FIGURE form average long axis particle size range limits.

For instance, variation in the amounts of the aluminum compound ($Al_2(SO_4)_3$) and of the zinc compound ($ZnSO_4$) respectively in Examples 8 and 10, as hereinafter presented, gives different average long axis values for the $\alpha$-FeOOH particles as shown in FIG. 1 of the accompanying drawing wherein Curve A is the relationship between the long axis (ordinate) and the amount of the zinc compound (abscissa) and Curve B is the relationship between the long axis (ordinate) and the amount of the aluminum compound (abscissa). As understood from these Curves, the particle size can be readily controlled by variation in the amount of the metal compound.

In another characteristic feature of the invention, the silicon compound is applied onto the surfaces of the $\alpha$-FeOOH or $\alpha$-$Fe_2O_3$ particles before the reduction step so that the silicon component forms the coating at the surfaces of the ferromagnetic particles of metallic iron as a result of the reduction under heating. Such coating of the silicon component is quite effective in preventing the particles from sintering and breaking.

In the process of this invention, the first step is oxidation of $Fe(OH)_2$ suspended in an aqueous medium adjusted to a pH of not less than 11 with gaseous oxygen to produce particles of $\alpha$-FeOOH. The oxidation is usually carried out by introducing an oxygen-containing gas such as air into the $Fe(OH)_2$ suspension at a temperature of 5° to 100° C., preferably of 20° to 80° C.

Adjustment of the aqueous medium to a pH of not less than 11 prior to the oxidation is necessary for obtaining ferromagnetic particles of metallic iron having a good density as the ultimate product. One of the typical procedures for preparation of a suspension of $Fe(OH)_2$ in an aqueous medium having a pH of not less than 11 comprises mixing of an aqueous solution of a ferrous salt such as ferrous sulfate and an aqueous solution of an alkali such as sodium hydroxide in the presence of an excessive amount of an alkali. Another procedure is addition of an alkali to a suspension of ferrous hydroxide in an aqueous medium.

The said aqueous $Fe(OH)_2$ suspension comprises at least one metal compound chosen from compounds of alkaline earth metals, zinc and aluminum. Specific examples of these compounds are magnesium hydroxide, calcium hydroxide, zinc sulfate, zinc chloride, zinc nitrate, aluminum sulfate, aluminum chloride, aluminum nitrate, etc. These compounds may be incorporated into the aqueous $Fe(OH)_2$ suspension or any starting aqueous solution for preparation of such aqueous $Fe(OH)_2$ suspension. The amount of these compounds to be present in the aqueous $Fe(OH)_2$ suspension may be such that the atomic ratio of the metal component (Me) in the said compounds to the iron component (Fe) in $Fe(OH)_2$ is from 0.001 to 0.1. When the amount is smaller than the lower limit, no technical effect is produced. When larger than the higher limit, the ferromagnetic particles as the ultimate product are too fine, and their magnetic characteristics are deteriorated.

In a preferred aspect of this invention, the aqueous $Fe(OH)_2$ suspension comprises additionally at least one nickel compound such as nickel hydroxide, nickel chloride, nickel sulfate and nickel nitrate. The presence of a nickel compound is effective in producing particles of $\alpha$-FeOOH in a needle-shape with an even size while preventing the formation of branched particles, which may be unfavorably sintered on the heat treatment and thus cause lowering of the magnetic characteristics. The amount of the nickel compound may be such that the atomic ratio of the nickel component (Ni) therein to the iron component (Fe) in $Fe(OH)_2$ is from 0.001 to 0.15. When the amount is smaller than the lower limit, no technical effect is produced. When larger than the higher limit, the magnetic characteristics are rather deteriorated. The incorporation of the nickel compound may be carried out substantially in the same manner as that of the said metal compound.

The $\alpha$-FeOOH particles obtained in the oxidation step may be optionally dehydrated under heating to give particles of $\alpha$-$Fe_2O_3$. Heating is usually carried out at a temperature of 300° to 1000° C. in the air.

The said $\alpha$-FeOOH particles or the $\alpha$-$Fe_2O_3$ particles as obtained above are then reduced under heating to give ferromagnetic particles of metallic iron. The reduction is usually carried out at a temperature of 300° to 600° C. in a reductive atmosphere such as hydrogen. The above heating sometimes causes damage to the size and shape of the resulting particles. The previous application of a coating of a silicon compound onto the $\alpha$-FeOOH or $\alpha$-$Fe_2O_3$ particles can prevent the occurrence of such damage and provide the particles obtained after reduction with excellent magnetic characteristics. Examples of the silicon compound are inorganic silicates (e.g. sodium silicate, potassium metasilicate, water glass), organic silicon compounds (e.g. silicone oil), etc. For application of the silicon compound, the $\alpha$-FeOOH or $\alpha$-$Fe_2O_3$ particles may be immersed, for instance, in an alkaline aqueous solution of an alkali silicate or a solution of silicone oil in an organic solvent. When an alkali silicate is used, carbon dioxide gas may be blown into its aqueous alkaline solution comprising the $\alpha$-FeOOH or $\alpha$-$Fe_2O_3$ particles for neutralization, whereby silicic acid sol is deposited on the surface of the particles.

In case of $\alpha$-$Fe_2O_3$ particles being used, treatment for application of a silicon compound may be carried out onto the $\alpha$-$Fe_2O_3$ particles themselves prior to their reduction to ferromagnetic particles of metallic iron and/or onto the $\alpha$-FeOOH particles prior to their dehydration to particles of $\alpha$-$Fe_2O_3$. The amount of the silicon compound to be applied onto the $\alpha$-FeOOH or $\alpha$-$Fe_2O_3$ particles may be such that the atomic ratio of the silicon component (Si) in the silicon compound to the iron component (Fe) in the $\alpha$-FeOOH or $\alpha$.$Fe_2O_3$ particles is from 0.001 to 0.06. When the amount is smaller than the lower limit, no technical effect is expected. When larger than the higher limit, unfavorable problems are produced in the magnetic characteristics.

The thus obtained ferromagnetic particles of metallic iron are evenly needle-shaped, and their magnetic characteristics such as coercive force (Hc) and square ratio ($\sigma r/\sigma s$) are quite excellent.

Practical and presently preferred embodiments of the invention are illustratively shown in the following Examples and Comparative Examples.

EXAMPLE 1

To an aqueous solution (1.5 liters) containing $FeSO_4.7H_2O$ (200 g/liter) and $MgSO_4.7H_2O$ (0.89 g/liter), an aqueous solution (1.5 liters) containing NaOH (200 g/liter) was added to make a suspension containing the co-precipitates of $Fe(OH)_2$ and $Mg(OH)_2$, of which the pH was more than 12. The suspension was warmed to 40° C., and air was introduced therein at a rate of 2 liters/minute for 8 hours, whereby particles of $\alpha$-FeOOH containing magnesium in a needle-shape were separated out. The $\alpha$-FeOOH particles were collected, washed with water and dried.

Ten grams of the $\alpha$-FeOOH particles were dispersed in an aqueous solution (0.5 liter) containing $Na_4SiO_4$ (4 g/liter), and carbon dioxide gas was blown into the dispersion at a rate of 2 liters/minute for 30 minutes for neutralization, whereby particles of $\alpha$-FeOOH having silicic acid sol deposited thereon were precipitated. The precipitated particles were collected, washed with water and dried.

One gram of the thus obtained $\alpha$-FeOOH particles was reduced by heating in an electric furnace at 400° C. under a stream of hydrogen at a rate of 1 liter/minute for 2 hours to give ferromagnetic particles of metallic iron containing magnesium and silicon. The average long axis of the particles was 0.3 μm. Axis ratio, 10.

EXAMPLE 2

In the same manner as in Example 1 but using an aqueous solution (1.5 liters) containing $FeSO_4.7H_2O$ (200 g/liter) and $MgSO_4.7H_2O$(3.55 g/liter) in place of an aqueous solution (1.5 liters) containing $FeSO_4.7H_2O$ (200 g/liter) and $MgSO_4.7H_2O$ (0.89 g/liter), there were prepared ferromagnetic particles of metallic iron containing magnesium and silicon. The average long axis of the particles was, 0.4 μm. Axis ratio, 12.

EXAMPLE 3

In the same manner as in Example 1 but using an aqueous solution (1.5 liters) containing $FeSO_4.7H_2O$ (200 g/liter) and $Ca(NO_3)_2.4H_2O$ (1.70 g/liter) in place of an aqueous solution (1.5 liters) containing $FeSO_4.7H_2O$ (0.89 g/liter), there were prepared ferromagnetic particles of metallic iron containing calcium and silicon. The average long axis of the particles was, 0.35 μm. Axis ratio, 10.

EXAMPLE 4

To an aqueous solution (1.5 liters) containing NaOH (200 g/liter), an aqueous solution (1.5 liters) containing $FeSO_4.7H_2O$ (200 g/liter) and $Ca(NO_3)_2.4H_2O$ (1.7 g/liter) was added while stirring to make a suspension containing the co-precipitate of $Fe(OH)_2$ and $Ca(OH)_2$, of which the pH was more than 12. The suspension was warmed to 20° C., and air was introduced therein at a rate of 1 liter/minute for 1 hour, whereby seed crystals of α-FeOOH were produced. The suspension was heated to 50° C., and air was blown therein at a rate of 2 liters/minute for 10 hours, whereby particles of α-FeOOH containing calcium in a needle shape were separated out. The α-FeOOH particles were collected, washed with water and dried.

Ten grams of the α-FeOOH particles were oxidized by heating in a muffle furnace at 600° C. under a stream of air at a rate of 1.5 liters/minute for 10 hours to make particles of $\alpha$-$Fe_2O_3$.

The $\alpha$-$Fe_2O_3$ particles as above obtained were dispersed in an aqueous solution (0.5 liter) containing $Na_4SiO_4$ (4 g/liter), and a 0.1 N HCl solution was added thereto to make a pH of 6.0, whereby particles of $\alpha$-$Fe_2O_3$ having silicic acid sol deposited thereon were precipitated. The precipitated particles were collected, washed with water and dried.

One gram of the thus obtained $\alpha$-$Fe_2O_3$ particles was reduced by heating in an electric furnace at 450° C. under a stream of hydrogen at a rate of 1 liter/minute for 2 hours to give ferromagnetic particles of metallic iron containing calcium and silicon. The average long axis of the particles was, 0.4 μm. Axis ratio, 10.

EXAMPLE 5

To an aqueous solution (1.5 liters) containing $FeSO_4.7H_2O$ (200 g/liter), an aqueous solution (0.125 liter) containing $NiSO_4.6H_2O$ (112 g/liter) and an aqueous solution (0.1 liter) containing $Ca(NO_3)_2.4H_2O$ (51.0 g/liter) were added, and an aqueous solution (1.5 liters) containing NaOH (200 g/liter) was added thereto, whereby a suspension containing the co-precipitate of $Fe(OH)_2$, $Ni(OH)_2$ and $Ca(OH)_2$ and having a pH of more than 12 was obtained. The suspension was warmed to 40° C., and air was blown therein at a rate of 1.65 liters/minute for 10 hours to precipitate particles of α-FeOOH containing nickel and calcium in a needle-shape, which were collected and washed with water.

Ten grams of the α-FeOOH particles were dispersed in an aqueous solution (0.5 liter) containing $Na_4SiO_4$ (4 g/liter), and carbon dioxide gas was blown therein at a rate of 2 liters/minute for 30 minutes for neutralization, whereby particles of α-FeOOH having silicic acid sol deposited thereon were precipitated. The precipitated particles were collected and washed with water.

One gram of the thus obtained α-FeOOH particles was heated in an electric furnace at 350° C. under a stream of hydrogen at a rate of 1 liter/minute for 2 hours, whereby ferromagnetic particles of metallic iron containing nickel, calcium and silicon were obtained.

EXAMPLE 6

To an aqueous solution (1.5 liters) containing $FeSO_4.7H_2O$ (200 g/liter), an aqueous solution (0.125 liter) containing $NiSO_4.6H_2O$ (112 g/liter) and an aqueous solution (0.05 liter) containing $MgSO_4.7H_2O$ (53.3 g/liter) were added while stirring, and an aqueous solution (1.5 liters) containing an NaOH (200 g/liter) was added thereto to make a suspension containing the co-precipitate of $Fe(OH)_2$, $Ni(OH)_2$ and $Mg(OH)_2$, of which the pH was more than 12. The suspension was warmed to 30° C., and air was introduced therein at a rate of 1.5 liters/minute for 1 hour, whereby seed crystals of α-FeOOH were produced. The suspension was heated to 50° C., and air was blown therein at a rate of 2.2 liters/minute for 10 hours, whereby particles of α-FeOOH containing nickel and magnesium in a needle shape were separated out. The α-FeOOH particles were collected, washed with water and dried.

The α-FeOOH particles thus obtained were dehydrated by heating in a muffle furnace at 600° C. under a stream of air at a rate of 1.2 liters/minute for 2 hours to make particles of $\alpha$-$Fe_2O_3$.

Ten grams of the $\alpha$-$Fe_2O_3$ particles were dispersed in an aqueous solution (0.3 liter) containing $Na_4SiO_4$ (4 g/liter), and carbon dioxide gas was blown therein at a rate of 1.5 liters/minute for 30 minutes, whereby particles of $\alpha$-$Fe_2O_3$ having silicic acid sol deposited thereon were precipitated. The precipitated particles were collected, washed with water and dried.

One gram of the thus obtained $\alpha$-$Fe_2O_3$ particles was reduced by heating in an electric furnace at 330° C. under a stream of hydrogen at a rate of 1 liter/minute for 2 hours to give ferromagnetic particles of metallic iron containing nickel, magnesium and silicon.

EXAMPLE 7

To an aqueous solution (1 liter) containing $FeSO_4.7H_2O$ (300 g/liter), an aqueous solution (0.1 liter) containing $NiSO_4.7H_2O$ (112 g/liter) and an aqueous solution (0.05 liter) of $Ca(NO_3)_2.4H_2O$ (51.0 g/liter) was added while stirring, and an aqueous solution (1 liter) of NaOH (300 g/liter) was added thereto to make a suspension containing the co-precipitate of $Fe(OH)_2$, $Ni(OH)_2$ and $Ca(OH)_2$, of which the pH was more than 12. The suspension was warmed to 40° C., and air was introduced therein at a rate of 1.5 liters/minute for 0.5 hour, whereby seed crystals of α-FeOOH were produced. The suspension was heated to 50° C., and air was blown therein at a rate of 2.5 liters/minute for 10 hours, whereby particles of α-FeOOH containing nickel and calcium in a needle shape were separated out. The α-FeOOH particles were collected, washed with water and dried.

The α-FeOOH particles thus obtained were dehydrated by heating in a muffle furnace at 550° C. under a stream of air at a rate of 1.5 liters/minute for 2 hours to make particles of $\alpha$-$Fe_2O_3$.

The grams of the $\alpha$-$Fe_2O_3$ particles were dispersed in an aqueous solution (0.5 liter) containing $Na_4SiO_4$ (4 g/liter), and a 0.1 N HCl solution was added thereto to make a pH of 7, whereby particles of $\alpha$-$Fe_2O_3$ having silicic acid sol deposited thereon were precipitated. The precipitated particles were collected, washed with water and dried.

One gram of the thus obtained $\alpha$-$Fe_2O_3$ particles was reduced by heating in an electric furnace at 380° C. under a stream of hydrogen at a rate of 1 liter/minute for 2 hours to give ferromagnetic particles of metallic iron containing nickel, calcium and silicon.

EXAMPLE 8

To an aqueous solution (1.5 liters) containing NaOH (200 g/liter), an aqueous solution containing $FeSO_4.7H_2O$ (200 g/liter) and $Al_2(SO_4)_3.17H_2O$ (1.17 g/liter) were added while stirring to make a suspension containing the co-precipitate of $Fe(OH)_2$ and $Al(OH)_3$, of which the pH was more than 12. The suspension was warmed to 40° C., and air was blown therein at a rate of 2 liters/minute for 8 hours to precipitate particles of α-FeOOH containing aluminum in a needle shape, which were collected and washed with water.

Ten grams of the α-FeOOH particles were dispersed in an aqueous solution (0.5 liter) containing $Na_4SiO_4$ (4 g/liter), and carbon dioxide gas was blown therein at a rate of 1.5 liters/minute for 30 minutes, whereby particles of α-FeOOH having silicic acid sol deposited thereon were precipitated. The precipitated particles were collected and washed with water.

One gram of the thus obtained α-FeOOH particles was heated in an electric furnace at 450° C. under a stream of hydrogen at a rate of 1 liter/minute for 2 hours, whereby ferromagnetic particles of metallic iron containing aluminum and silicon were obtained.

EXAMPLE 9

To an aqueous solution (1.5 liters) containing $FeSO_4.7H_2O$ (200 g/liter), an aqueous solution (1.5 liters) containing NaOH (200 g/liter) to make a suspension containing the precipitate of $Fe(OH)_2$. To the suspension, an aqueous solution (0.1 liter) containing $Al_2(SO_4)_3$ (23.4 g/liter) was added, and the resultant suspension having a pH of not more than 12 was warmed to 30° C. Air was introduced therein at a rate of 2 liters/minute for 30 minutes, whereby seed crystals of α-FeOOH were produced. The suspension was heated to 50° C., and air was blown therein at a rate of 2 liters/minute for 10 hours, whereby particles of α-FeOOH containing aluminum in a needle shape were separated out. The α-FeOOH particles were collected, washed with water and dried.

Ten grams of the α-FeOOH particles were dehydrated by heating in a muffle furnace at 600° C. under a stream of air at a rate of 1.5 liters/minute for 3 hours to make particles of $\alpha$-$Fe_2O_3$.

The $\alpha$-$Fe_2O_3$ particles as above obtained were dispersed in an aqueous solution (0.5 liter) containing $Na_4SiO_4$ (4 g/liter), and a 0.1 N HCl solution was added thereto to make a pH of 7, whereby particles of $\alpha$-$Fe_2O_3$ having silicic acid sol deposited thereon were precipitated. The precipitated particles were collected, washed with water and dried.

One gram of the thus obtained $\alpha$-$Fe_2O_3$ particles was reduced by heating in an electric furnace at 450° C. under a stream of hydrogen at a rate of 1 liter/minute for 2 hours to give ferromagnetic particles of metallic iron containing calcium and silicon.

EXAMPLE 10

In the same manner as in Example 8 but using an aqueous solution (1.5 liters) containing $FeSO_4.7H_2O$ (200 g/liter) and $ZnSO_4.7H_2O$ (2.07 g/liter) in place of an aqueous solution (1.4 liters) containing $FeSO_4.7H_2O$ (200 g/liter) and an aqueous solution (0.1 liter) of $Al_2(SO_4)_3.17H_2O$ (23.4 g/liter), there was produced ferromagnetic particles of metallic iron containing zinc and silicon.

COMPARATIVE EXAMPLE 1

In the same manner as in Example 1 but using an aqueous solution (1.5 liters) containing $FeSO_4.7H_2O$ (200 g/liter) in place of an aqueous solution (1.5 liters) containing $FeSO_4.7H_2O$ (200 g/liter) and $MgSO_4.7H_2O$ (0.89 g/liter), there were produced ferromagnetic particles of metallic iron containing silicon. The average long axis of the particles, 0.45 μm. Axis ratio, 12.

COMPARATIVE EXAMPLE 2

In the same manner as in Example 2 but not effecting the treatment with a silicon compound ($Na_4SiO_4$), there were produced ferromagnetic particles of metallic iron containing magnesium. The average long axis of the particles was 0.35 μm. Axis ratio, 10.

COMPARATIVE EXAMPLE 3

In the same manner as in Example 5 but not using an aqueous solution (0.1 liter) containing $Ca(NO_3)_2.4H_2O$ (51.0 g/liter), there were produced ferromagnetic particles of metallic iron containing nickel and silicon.

COMPARATIVE EXAMPLE 4

In the same manner as in Example 8 but not effecting the treatment with a silicon compound ($Na_4SiO_4$), there were produced ferromagnetic particles of metallic iron containing aluminum.

COMPARATIVE EXAMPLE 5

In the same manner as in Example 10 but not effecting the treatment with a silicon compound ($Na_4SiO_4$), there were produced ferromagnetic particles of metallic iron containing zinc.

The ferromagnetic particles of metallic iron as prepared in the foregoing Examples and Comparative Examples were subjected to measurement of saturation magnetization (σs), coercive force (Hc) and square ratio (σr/σs). The results are shown in Table 1.

TABLE 1

| | Saturation magnetization (emu/g) | Coercive force (Oe) | Square ratio |
|---|---|---|---|
| Example | | | |
| 1 | 156 | 470 | 0.52 |
| 2 | 151 | 445 | 0.52 |
| 3 | 154 | 345 | 0.51 |
| 4 | 154 | 425 | 0.52 |
| 5 | 154 | 375 | 0.52 |
| 6 | 154 | 460 | 0.52 |
| 7 | 152 | 390 | 0.52 |
| 8 | 152 | 390 | 0.53 |
| 9 | 150 | 460 | 0.53 |
| 10 | 161 | 345 | 0.52 |
| Comparative | | | |
| 1 | 153 | 190 | 0.48 |
| 2 | 156 | 970 | 0.45 |
| 3 | 151 | 180 | 0.46 |
| 4 | 156 | 985 | 0.45 |
| 5 | 153 | 040 | 0.47 |

As understood from the above results, the process of this invention can prevent the production of branced particles at the stage for growth of α-FeOOH particles. It can also efficiently inhibit sintering and breaking of the particles upon heat treatment. As the result, the produced ferromagnetic particles of metallic iron exhibit excellent magnetic characteristics.

What is claimed is:

1. A process for preparing ferromagnetic particles comprising metallic iron as the major component, the process comprising:

oxidizing $Fe(OH)_2$ in an aqueous medium adjusted to a pH of not less than 11 with gaseous oxygen to produce particles of α-FeOOH, said aqueous medium comprises an alkaline earth metal compound in an amount such that the atomic ratio of the alkaline earth metal in said alkaline earth metal compound to the iron (Fe) component in $Fe(OH)_2$ is from 0.001 to 0.1;

optionally dehydrating the thus obtained α-FeOOH particles under heating to produce particles of α-$Fe_2O_3$;

coating the α-FeOOH or α-$Fe_2O_3$ particles with a coating comprising a silicon compound; and reducing the thus obtained silicon compound coated α-FeOOH or α-$Fe_2O_3$ particles under heating, whereby ferromagnetic particles of metallic iron having an average long axis particle size with range limits formed by curves A and B in FIG. 1 and having enhanced magnetic characteristics are obtained.

2. The process according to claim 1, wherein the alkaline earth metal compound is magnesium hydroxide or calcium hydroxide.

3. The process according to claim 1, wherein the aqueous medium comprises additionally a nickel compound.

4. The process according to claim 3, wherein the nickel compound is nickel hydroxide.

5. The process according to claim 1, wherein the amount of the silicon compound is such that the atomic ratio of the silicon component in the silicon compound to the iron component in the α-FeOOH or α-$Fe_2O_3$ particles is from 0.001 to 0.006.

6. The process according to claim 1, wherein the α-FeOOH particles are dehydrated to particles of α-$Fe_2O_3$ and the α-$Fe_2O_3$ particles are reduced to particles of ferromagnetic particles of metallic iron.

* * * * *